US005435642A

United States Patent [19]

Kennedy

[11] Patent Number: 5,435,642

[45] Date of Patent: Jul. 25, 1995

[54] COMBINED COOLER-SEAT SPORTS GEAR BOX

[75] Inventor: Thomas A. Kennedy, New Hope, Pa.

[73] Assignee: T.A.K. Enterprises, Inc., Flemington, N.J.

[21] Appl. No.: 213,151

[22] Filed: Mar. 14, 1994

[51] Int. Cl.[6] ..... A47B 83/02; A47B 3/14

[52] U.S. Cl. ..... 312/235.2; 297/188.11; 297/188.13

[58] Field of Search ..... 312/235.1-235.9, 312/236, 241, 270.1, 270.3; 297/188.08, 188.11, 188.13, 344.26; 206/315.11

[56] References Cited

U.S. PATENT DOCUMENTS

| | | | |
|---|---|---|---|
| D. 256,630 | 9/1980 | Maney | D7/605 |
| 2,264,744 | 12/1941 | Dunnam | 297/188.13 |
| 3,310,905 | 3/1967 | Davis et al. | 206/315.11 X |
| 4,210,363 | 7/1980 | Taipalus | 297/192 |
| 4,353,182 | 10/1982 | Junkas et al. | 312/235.5 X |
| 4,474,407 | 10/1984 | Nazar | 297/192 |
| 4,556,250 | 12/1985 | Chapman et al. | 312/235.2 |
| 4,773,709 | 9/1988 | Slinkard | 297/193 |
| 4,775,187 | 10/1988 | Herr | 297/344.22 X |
| 5,100,198 | 3/1992 | Baltzell | 312/235.2 |
| 5,209,178 | 5/1993 | Rowe | 297/217 X |
| 5,234,143 | 8/1993 | Mahvi et al. | 224/31 |

OTHER PUBLICATIONS

Coleman of Wichita, Kansas–K–Mart sales brochure/-Winter 1993.

Rubbermaid of Akron, Ohio–K–Mart sales brochure/-Winter 1993.

Plano Corporation of Plano, Ill.–Field & Stream and Outdoor Life/both Nov. 1993.

Bass Pro of St. Louis, Mo.–Pro Bass Magazine/Fall 1993.

*Primary Examiner*—Kenneth J. Dorner
*Assistant Examiner*—Robert J. Sandy
*Attorney, Agent, or Firm*—Kenneth P. Glynn

[57] ABSTRACT

The present invention is a combination cooler-seat-gear and food storage and transporting device. It includes a main housing having a closed bottom, sidewalls, a top and a front. The housing has inner walls and outer walls and has heat insulation therebetween. It includes an open front with at least one hinged door thereon, and it contains a plurality of horizontal drawer supports with a plurality of drawers slidably located within the housing. There is a seat located on the top of the housing, as well as handles for manually carrying same. The handles may be built in or may be adjustable straps. In one preferred embodiment, the housing further includes an external shelf which is movable relative to the housing so as to have a first position which is a rest position, and to have a second position which is an open position.

20 Claims, 6 Drawing Sheets

COMBINED COOLER-SEAT SPORTS GEAR BOX

BACKGROUND OF THE INVENTION

1. Field of the Invention

The present invention is directed to a combination device which acts as a portable storage device, a cooler and a seat. More specifically, the present invention involves such devices as will permit access to various storage areas without removal of other storage areas. The present invention device may be used for sports activities or any other outdoor activities which may require waiting, seating, food storage and possible storage of gear or equipment. It may be in the form of a backpack and may, for example, be used as a fishing tackle box-cooler-seat.

2. Description of the Prior Art

Campers, hunters, fishermen and other people involved in other outdoor activities have used various types of coolers as well as various types of tackle boxes and sports gear boxes. Coleman of Wichita, Kans. manufactures single area coolers and multiple compartment coolers, and Rubbermaid of Akron, Ohio likewise manufactures and sells multiple compartment coolers. However, these all have lids which are hinged at the top horizontally and swing up to open or are removable upwardly to open. A sales brochure from K-mart, from Winter of 1993, illustrates Coleman coolers as well as Rubbermaid coolers, all with open tops. Tackle boxes have been developed by Plano Corporation of Plano, Ill. and these include stowaway tackle boxes with top and front openings as shown on the two pages from Field & Stream and Outdoor Life, both November, 1993.

Some coolers have been adapted to include seats and straps and Bass Pro of St. Louis, Mo., sells padded stools with swivelling seats which include storage bags underneath. Bass Pro also sells cooler stool fanny packs and separately sells rigid, top opening coolers with seats. These are shown on a one page sales brochure from the Fall 1993 issue of Pro Bass Magazine.

SUMMARY OF THE INVENTION

The present invention is a combination portable cooler-seat-gear and food storage and transporting device. It includes a main housing having a closed bottom, sidewalls, a top and a front. The housing has inner walls and outer walls and has heat insulation therebetween. It includes an open front with at least one hinged door thereon, and it contains a plurality of horizontal drawer supports with a plurality of drawers slidably located within the housing. There is a seat located on the top of the housing, as well as handles for manually carrying same or straps for use as a backpack. In one preferred embodiment, the housing further includes an external shelf which is movable relative to the housing so as to have a first position which is a rest position, and to have a second position which is an open position.

BRIEF DESCRIPTION OF THE DRAWINGS

The present invention should be more fully understood when the specification herein is taken in conjunction with the drawings appended hereto, wherein.

DETAILED DESCRIPTION OF THE PRESENT INVENTION

Figure 1:
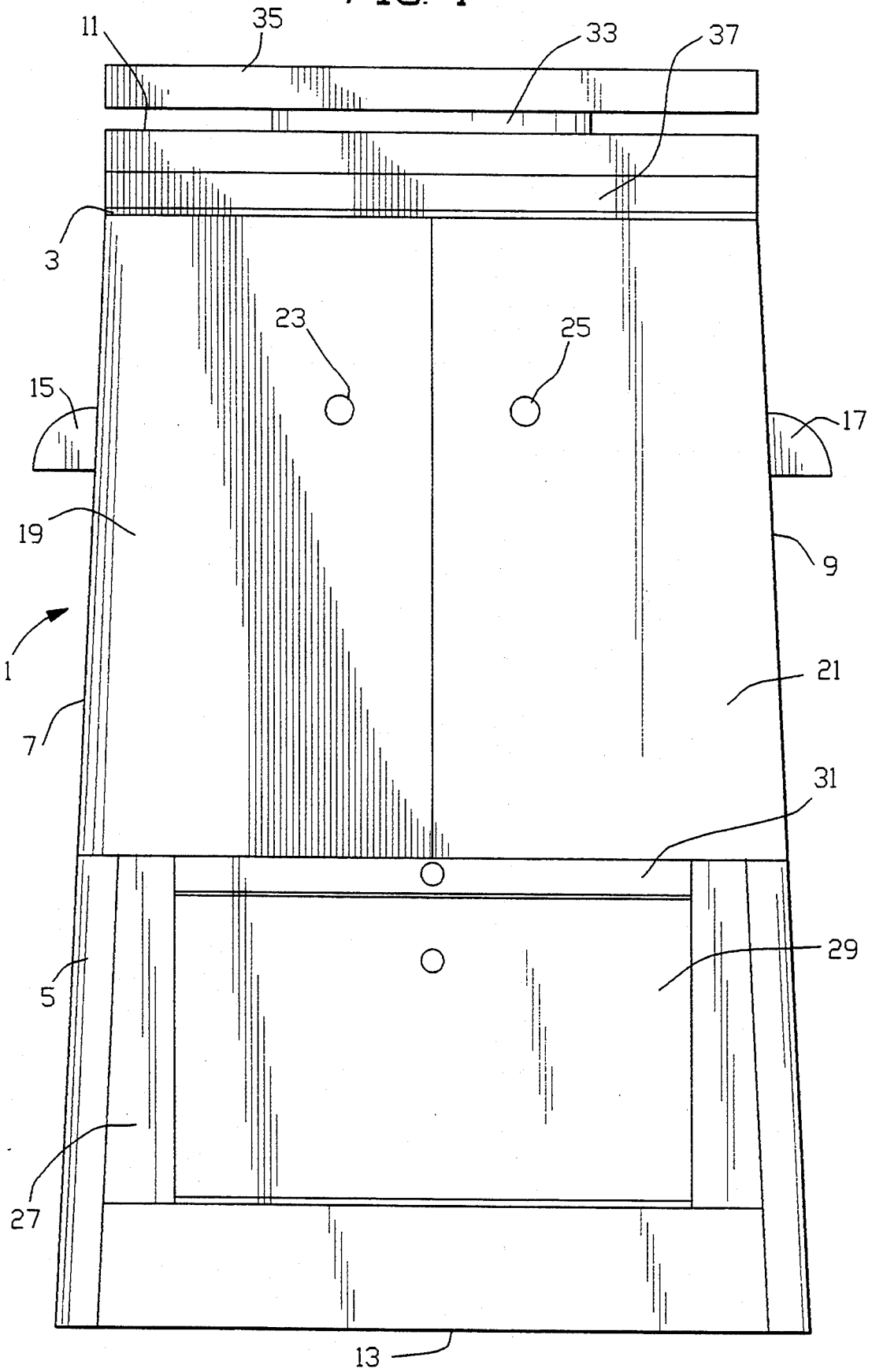
FIG. 1 shows a front view of a present invention device.

Referring now to FIG. 1, there is shown a front view of present invention device 1. Device 1 is a combined cooler-seat-storage and transporting device and may advantageously be used for sports, especially for hunting and fishing, and for other outdoor activities such as camping, outdoor spectator events, local sports games, e.g. high school or little league football, soccer or baseball games, beach going, canoeing, boating, outdoor painting, temporary outdoor stands such as at flea markets, as well as thousands of other uses immediately foreseeable to the artisan once the device is described. The device can be used to provide a seat, while providing separate storage areas for sports gear, ammunition, fishing tackle, lures, camping equipment, etc., and for food which may be kept cool due to the insulative cooler aspects of the present invention.

Figure 2:
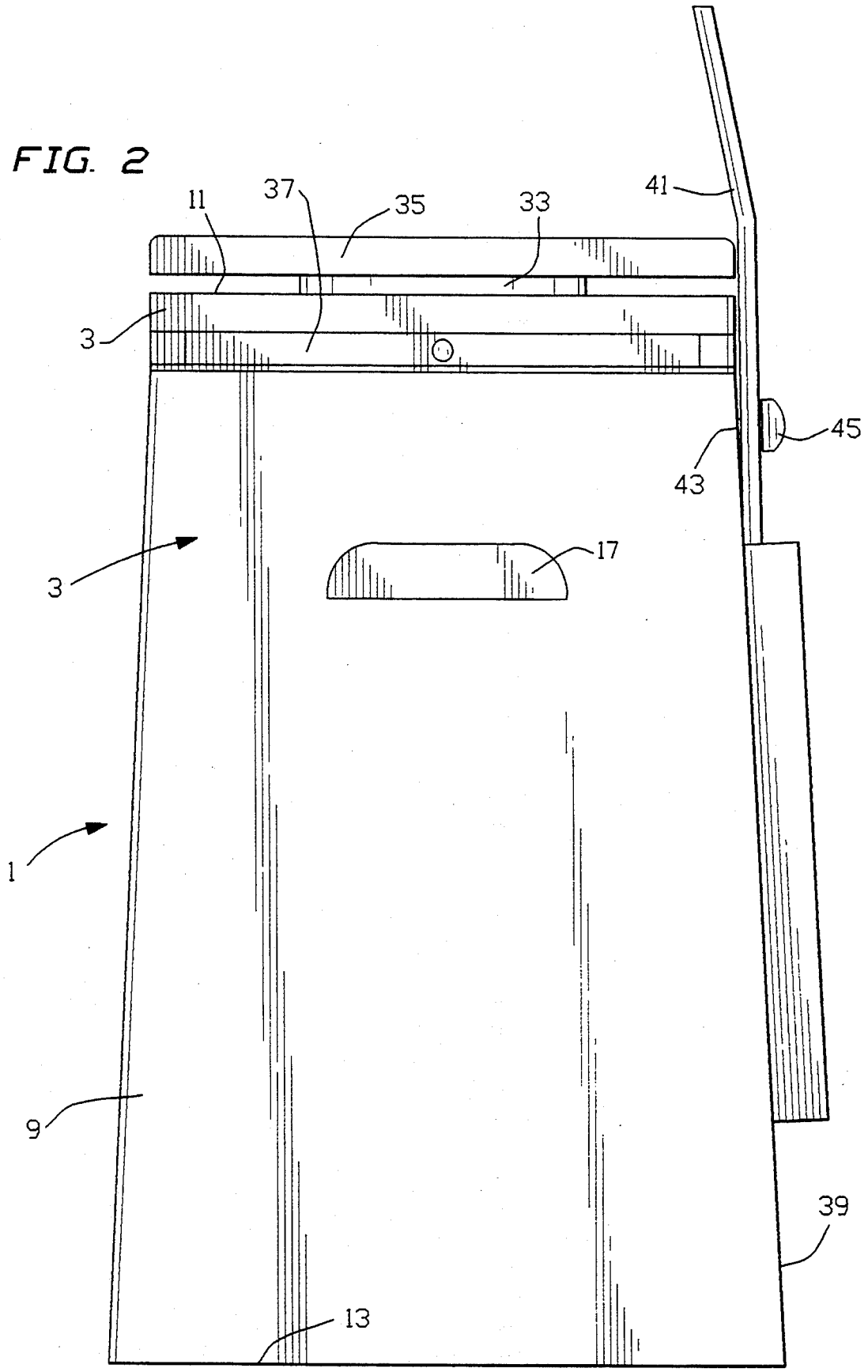
FIG. 2 shows a side view of the device shown in FIG. 1.

Device 1 includes a main housing 3 with a front 5 and sidewalls 7 and 9 and a back (not shown), as well as a top 11 and a bottom 13. It has generally rectangular surfaces but is tapered inwardly going from top to bottom so as to be a truncated pyramid. There are handling means, here, handles 15 and 17 located on sidewalls 7 and 9 respectively. Also, front 5 has doors 19 and 21, as shown, with opening finger recesses 23 and 25. There is a lower section 27 which includes a cooler drawer 29 for direct access, as well as a pull out shelf 31. At top 11 is a swivel post 33 and a swivel seat 35. Top 3 includes pull out shelf 37. FIG. 2 shows a side view of device 1 but now including seat back 41. It includes a knob 45 and bolt 43 on back 39 for attachment and removal of seat back 41. Also, pad 47 is included and may be removably attached. This may be used in place for padding to the body as when carried in knapsack fashion with straps (shown and discussed below) or removed and used separate from device 1, or against seat back 41, as desired. All other aspects that are shown in FIG. 1 are identically numbered.

Figure 3:
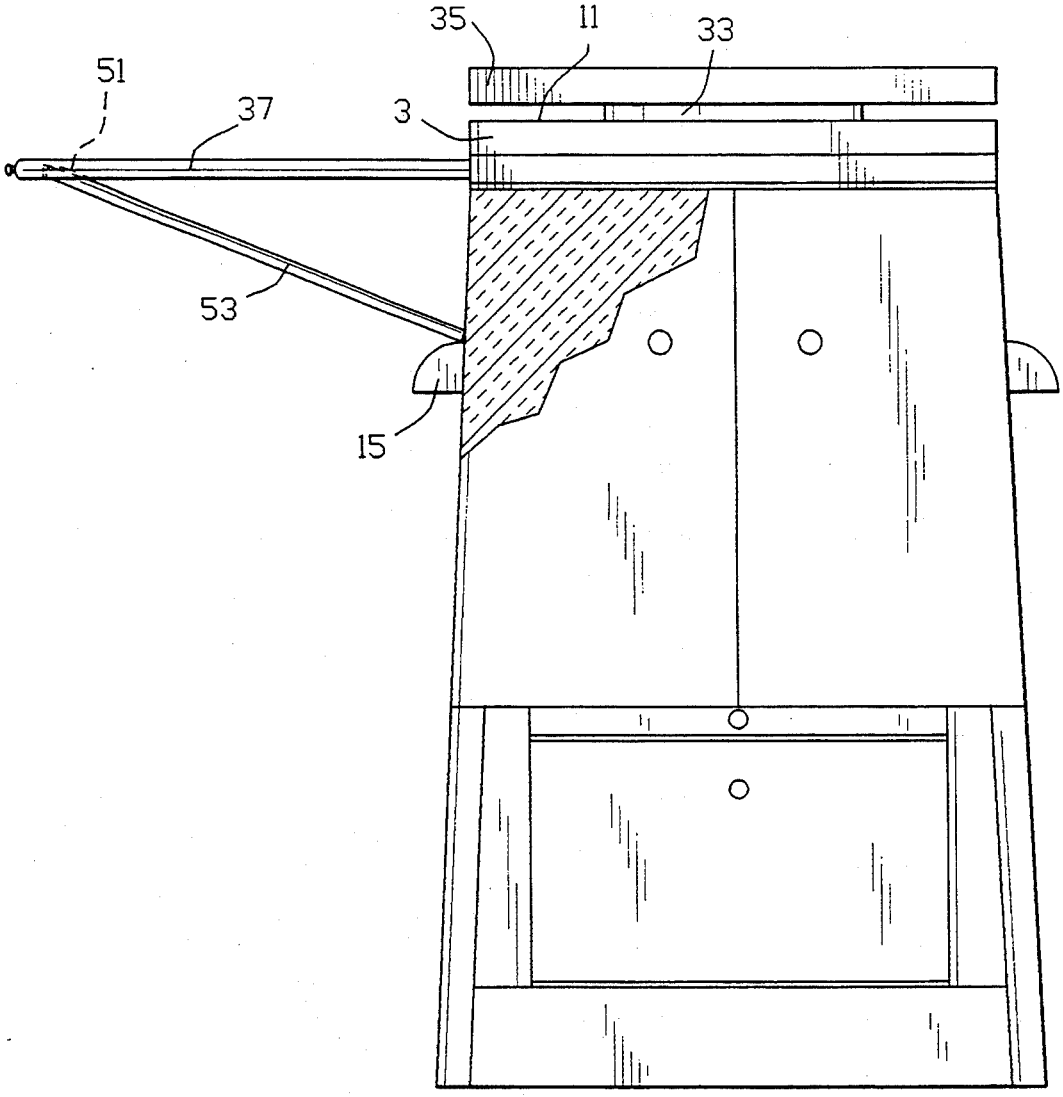
FIG. 3 shows a partial front view of the device shown in FIGS. 1 and 2 but with a pull out shelf in its open position.

FIG. 3 shows a partial front view of device 1 shown in FIG. 1, with pull out shelf 37 in its open position. There is a recess 51 for receiving an end of support member 53. Note that support member 53 rests at its opposite end on handle 15. Shelf 37 has a stop (not shown) to prevent it from being pulled out beyond its open (shown) position.

Figure 4:
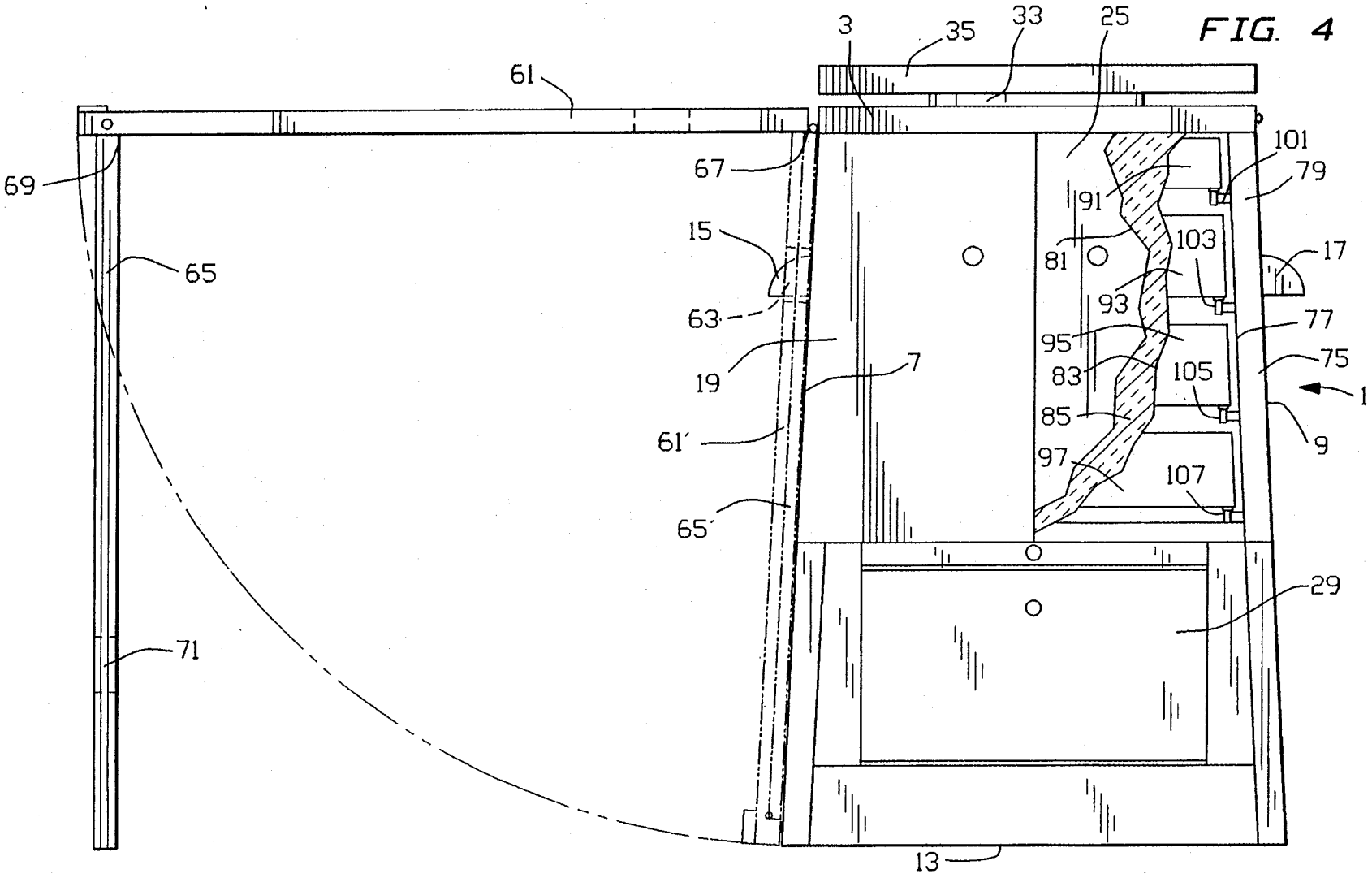
FIG. 4 shows a present invention device modified to include a hinged shelf and shows a partial cut away section to illustrate insulation between inner and outer walls.

FIG. 4 shows device 1 modified to include a hinged shelf 61, shown in both its rest position 61 and its open position 61. There is a cut out 63 so that shelf 61 fits over a handle 15 and support member 65 is shown in its open position as member 65 and in its closed position as member 65'. Shelf 61 is hingedly connected to housing 3 via hinge 67 and support member 65 is hingedly connected to shelf 61 via hinge 69.

Also shown in FIG. 4 is a partial cut away of device 1 showing sidewall 9 as having an outer wall 75 and an inner wall 77 with heat insulation 79 therebetween. This insulation may be cork, foam, pellet, glass fiber packing or any other known insulation. Likewise, door 25 is shown to have an outer wall 81, an inner wall 83 and insulation 85. Drawers 91, 93, 95 and 97 are also shown, with drawer supports 101, 103, 105 and 107.

Figure 5:
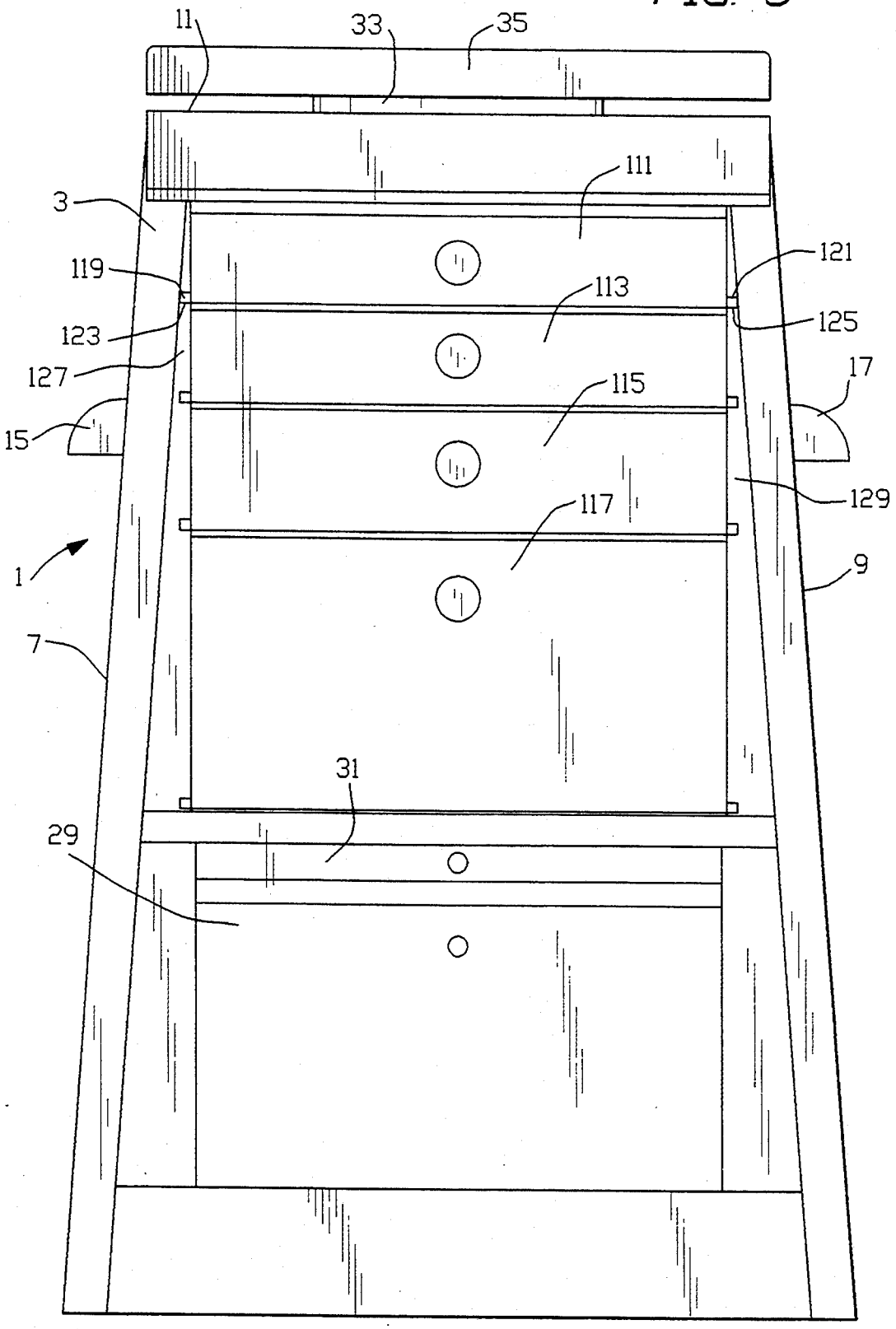
FIG. 5 shows a front view of a present invention device with its doors removed to show one embodiment of a drawer arrangement; and, FIG. 6 shows a back view of a present invention device with knapsack type adaptation.

FIG. 5 shows a front view of device 1 with the doors removed to show an alternative arrangement of drawers and supports from those shown in FIG. 4. Here drawers 111, 113, 115 and 117 are shown, with the top drawers 111 and 113 being smaller in height and drawer 117 being larger. These drawers 111, 113, 115 and 117 have "wings" or flanges such as flanges 119 and 121 (drawer 111) which slide in recesses 123 and 125 of inner walls 127 and 129.

Figure 6:
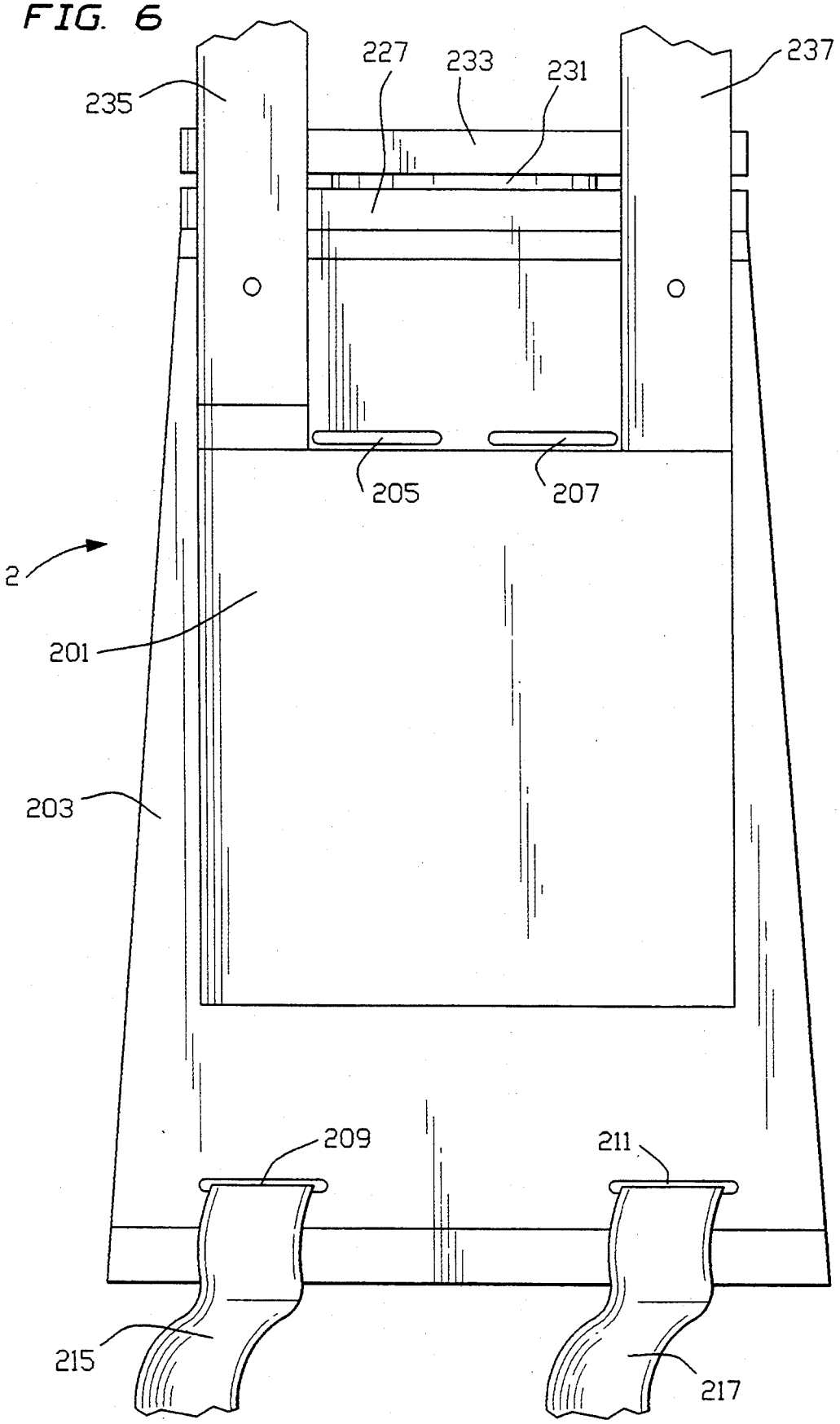

FIG. 6 shows a back view of present invention device 2 with a back pad 201 located on back 203 and with knapsack strap slots 205, 207, 209 and 211 located as shown, and partial straps 215 and 217. These straps would feed into slots 205 and 207 respectively, and would be adjustable. The straps 215 and 217 could be connected front to back (front not shown) and be extended by adjustment to be carried over-the-shoulder or be adjusted so as to permit hand carrying of the device 2. Also shown in FIG. 6 is seat 233 on swivel 231 on top 227 with back supports 235 and 237 shown in part.

The present invention devices afford access to different storage areas without removal of unneeded storage areas. Thus, unlike the prior art, top lid devices requiring removal of layers of boxes, bins, drawers or goods to get at lower goods, the present invention device permits immediate, direct access to any level. Also, these drawers may include ice or cooler packs or not, depending upon desired use, and the drawers themselves may be modular and have removable or movable sections so as to be adapted to specific needs, e.g. fishing lures, lunch, beer, caught fish, ammunition, cold food, room temperature food, maps, knife, paper or plastic products, e.g. plates, etc.

Obviously, numerous modifications and variations of the present invention are possible in light of the above teachings. It is therefore understood that within the scope of the appended claims, the invention may be practiced otherwise than as specifically described herein.

What is claimed is:

1. A combination cooler-seat-sports gear storage and transporting device, which comprises:

a) a main housing having a closed bottom, sidewalls, a top and a front, said housing having inner walls and outer walls and having heat insulation therebetween, said housing further having an open front with a hinged door thereon, said door also having inner walls and outer walls with heat insulation therein, said housing further containing a plurality of horizontal drawer supports thereon;

b) a plurality of drawers located within said housing and slidably connected to said drawer supports for horizontal opening and closing thereof; wherein at least a portion of said plurality of drawers are located inside said housing behind said door;

c) a seat located on said top of said housing; and, d) handling means on said housing for manually carrying same.

2. The device of claim 1 wherein said main housing is generally rectangular in shape.

3. The device of claim 1 wherein said main housing is tapered inwardly from its bottom upwardly to enhance stability.

4. The device of claim 1 where said housing further includes an external shelf which is movable relative to said housing so as to have a first position which is a rest position wherein said shelf is substantially contiguous to said housing, and to have a second position which is open position wherein said shelf is in an exposed horizontal postion.

5. The device of claim 1 wherein there are double doors on the front of said housing.

6. The device of claim 1 wherein said seat is a swivel seat.

7. The device of claim 1 wherein said seat includes a cushion.

8. The device of claim 6 wherein said seat includes a cushion.

9. The device of claim 1 wherein said seat includes a back support member.

10. The device of claim 9 wherein said back support memeber is foldable.

11. The devices of claim 6 wherein said seat includes a back support member.

12. The device of claim 11 wherein said back support member is foldable.

13. The device of claim 1 wherein said handling means is two protruding handles located on the sidewalls of said housing.

14. The device of claim 1 wherein said handling means is al least one adjustable strap.

15. The device of claim 14 wherein there are two adjustable straps connected to said housing so as to permit carrying of said device in a knapsack fashion.

16. The device of claim 5 wherein at least one adjustable strap may be adjusted to a hand carrying postion to a shoulder strap position.

17. The device of claim 3 wherein said external shelf is slidably mounted within said housing in a horizontal position so as to be slidable to its open position.

18. The device of claim 3 wherein said external shelf is hingedly mounted on the outside of said housing in a vertical position for its rest position and is rotated into a horizontal postion position for its open position.

19. The device of claim 18 wherein said shelf includes a support to enhance its stability in its open position.

20. The device of claim 19 wherein said support is a support memeber adapted to rest on a handle when said shelf is in said open position.

* * * * *